US005606881A

United States Patent [19]

Drake

[11] Patent Number: 5,606,881

[45] Date of Patent: Mar. 4, 1997

[54] KEY OPERABLE SAFETY SWITCH

[75] Inventor: David Drake, Letchworth, England

[73] Assignee: K.A. Schmersal GmbH & Co., Wuppertal, Germany

[21] Appl. No.: 559,730

[22] Filed: Nov. 15, 1995

Related U.S. Application Data

[63] Continuation of Ser. No. 177,587, Jan. 5, 1994, abandoned.

[30] Foreign Application Priority Data

Jan. 5, 1993 [GB] United Kingdom ..... 9300100
May 8, 1993 [DE] Germany ..... 43 15 376.3

[51] Int. Cl.[6] ..... E05B 35/04
[52] U.S. Cl. ..... 70/352; 70/386; 70/387
[58] Field of Search ..... 70/352, 386, 387

[56] References Cited

U.S. PATENT DOCUMENTS

| | | | |
|---|---|---|---|
| 4,149,394 | 4/1979 | Sornes | 70/352 |
| 4,452,059 | 6/1984 | Sornes | 70/352 |
| 5,025,647 | 6/1991 | Muus | 70/352 |
| 5,343,724 | 9/1994 | Sornes | 70/386 |
| 5,355,701 | 10/1994 | Tobias | 70/352 |

FOREIGN PATENT DOCUMENTS

| | | | |
|---|---|---|---|
| 0175156 | 8/1985 | European Pat. Off. . | |
| 2344473 | 4/1976 | Germany . | |
| 8800701.4 | 4/1988 | Germany . | |
| 3810287 | 3/1992 | Germany . | |
| 4039652C1 | 3/1992 | Germany . | |
| 83/01643 | 5/1983 | WIPO | 70/277 |

*Primary Examiner*—Steven N. Meyers
*Assistant Examiner*—Tuyet-Phuong Pham
*Attorney, Agent, or Firm*—Chilton, Alix & Van Kirk

[57] ABSTRACT

A key operable electrical safety switch includes a housing and a switch operator that is operated by an actuator. A slot in the housing receives the actuator. A plurality of pin stacks, the stacks having axes that are parallel and perpendicular to the slot, are spring biased to extend into the slot. At least one of the pins engages the actuator to lock it in a fixed position relative to the housing. The actuator is released from the locked position, and displaced a predetermined stroke to actuate the switch operator and thereby change the state of the switch contacts, by a key. The key has a coded pattern of pin receiving holes corresponding to the locking pins to align the pins and release the actuator. The pins are correspondingly codeable.

12 Claims, 4 Drawing Sheets

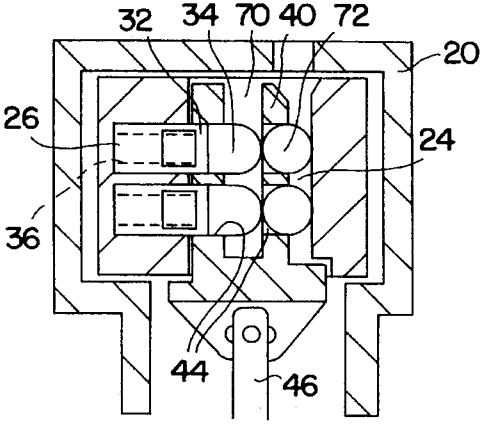
FIG. 4a
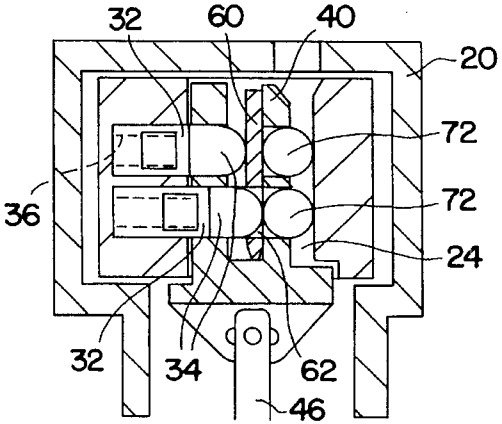
FIG. 4b
FIG. 4c
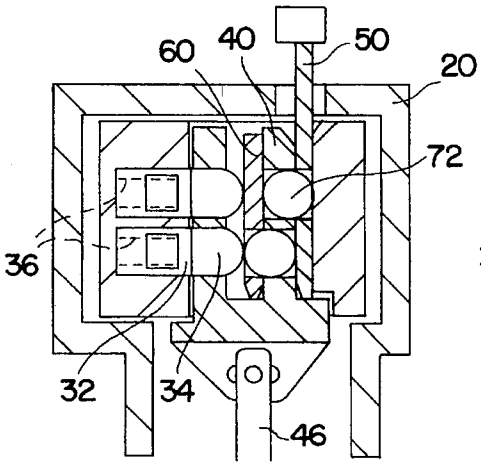
FIG. 4d
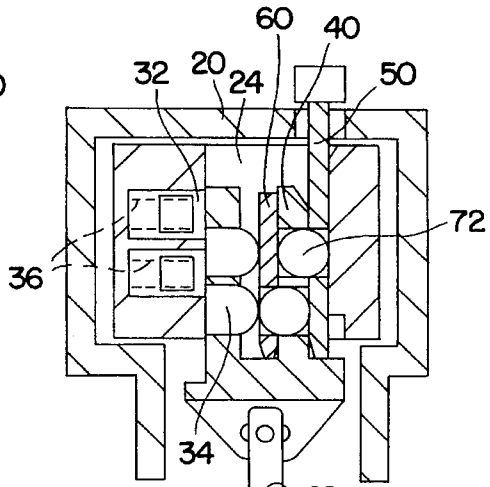
FIG. 4e

KEY OPERABLE SAFETY SWITCH

This is a continuation of application Ser. No. 08/177,587 filed on Jan. 5, 1994 now abandoned.

BACKGROUND OF THE INVENTION

This invention relates generally to key operated protective devices and especially to power control devices which can be employed to prevent the unauthorized use of machinery. More particularly, the present invention relates to key operable safety switches of the type used as safety guard switches.

While not limited thereto in its utility, the present invention is particularly well suited for use as a safety guard switch for electrically powered machinery. Such switches are known in the art as exemplified by the disclosure of European Patent Specification 175,156. A switch of the type shown in this European Patent Specification generally includes an actuating member or key, a housing, a contact, a switching roller and roller parts. In operation of the prior art safety switch, the key is inserted through an opening in the housing, axially displacing the roller parts and releasing the switching roller. Subsequent rotation of the key rotates the switching roller thereby causing the switch contacts to either close or open.

SUMMARY OF THE INVENTION

A key operable safety switch in accordance with the present invention comprises a housing accommodating a plurality of resiliently biased pins, a reciprocally moveable actuating member, a switch positioned for operation by the actuating member and a key. The actuating member is apertured and at least some of the pins normally cooperate with the actuating member apertures to lock this member against movement. The key has a blade portion which is provided with a coded pattern of holes. The key blade is inserted through a slot in the housing so as to be juxtapositioned to the actuator. If the pattern of holes in the key blade matches the switch code during key blade insertion, holes in the inserted key will come into registration with apertures in the actuating member. In such cases, the key selectively permits repositioning of some of the pins and, in so doing, simultaneously releases the actuating member for movement and couples the actuating member to the key. Continued insertion of the key causes the actuating member to perform the switch actuating function by imparting movement thereto. The arrangement is preferably reversible. Withdrawing the key causes the actuating member to perform a de-actuating function and disengages the key from the actuating member. On withdrawal of the key, the pins are restored to the position wherein the actuating member is locked in position.

The pins comprise spring loaded pin stacks consisting at least of foot pins, i.e., driver pins, and head pins, i.e., bottom pins. In the locked condition, at least one of the pins of one of the pin stacks extends into an aperture in the actuating member. This results in one of the pins of that pin stack bridging the shear plane between the actuating member and an immoveable member, i.e., the interface between the head and foot pins of the said one pin stack is out of alignment with the interface between the actuating member and the facing wall of the housing or a housing insert which, in part, defines the slot in which the actuating member moves. Accordingly, the actuating member is locked in position. When the key is inserted the pin stacks are displaced to align the head-foot pin interfaces with the shear plane thereby enabling movement of the actuating member with the key. By arranging for at least one of the head pins of a displaced pin stack to engage both an aperture in the actuating member and a hole in the key, continued movement of the key is able to drive the actuating member to perform an actuating function.

The pins may be of equal or unequal lengths and are selectively displaced or not displaced dependent on the coded pattern of holes in the key. If the pins are of equal length, a code card is inserted into the switch housing to set the pattern of the pins to match the coded pattern of holes in the key. The coding card, which moves with the actuating member, selectively displaces the pins to provide an arrangement equivalent to that of a switch manufactured with pins of unequal lengths corresponding to a predetermined code.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which:

FIGS. 4*a*, 4*b*, 4*c*, 4*d* and 4*e* are cross-sectional views of the switch of FIG. 3, the figures demonstrating operation of the switch.

DETAILED DESCRIPTION OF THE DISCLOSED EMBODIMENTS

Figure 1:
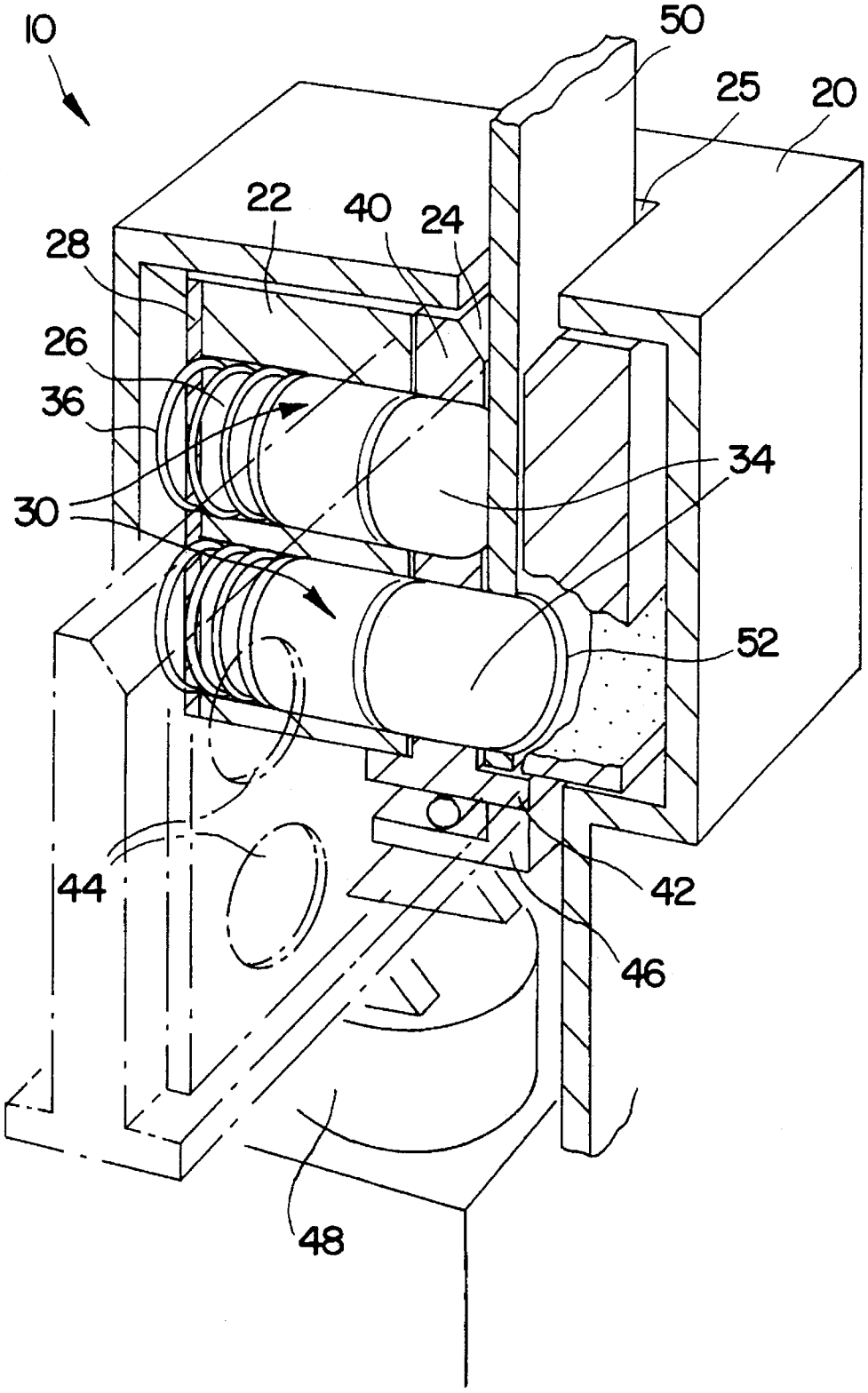
FIG. 1 is a partial perspective view of a key operable safety switch in accordance with a first embodiment of the present invention.

With reference to the drawings, wherein like numerals represent like parts throughout the several figures, a key operable safety switch in accordance with the present invention is generally designated by the numeral 10. The primary components of switch 10 are a housing 20, a housing insert 22, a plurality of pin stacks 30, an actuator member 40, and a key having a planar blade 50.

Referring to FIGS. 1, 2*a*, 2*b*, and 2*c*, housing 20 accommodates the block shaped insert 22. The insert 22, in turn, defines an actuator chamber 24 and a plurality of pin stack receiving bores 26. In the disclosed embodiments, the bores 26 are arranged in two parallel rows, one above the other. The bores 26 are closed on one end by a wall 28, attached to the insert 22, and intersect chamber 24 at their other ends. The actuator chamber 24 is thus oriented generally perpendicular to the axes of the bores 26. The bores each receive a pin stack 30.

The pin stacks 30 each comprise a foot or driver pin 32 and a separate rounded head or bottom pin 34. The foot pieces 32 each have a partial axial bore, i.e., a blind hole, which functions as a seat for receiving one end of a compression spring 36. The other ends of the springs 36 contacts the wall 28. The springs 36 bias the pin stacks 30 in the direction of an actuating member 40 disclosed in actuator chamber 24 so that the head pins 34 project out of the bores 26 into chamber 24.

The insert 22, pin stacks 30 and springs 36 may be inserted pre-assembled into the housing 20.

The actuator member 40 has a generally plate-shaped leg portion disposed for reciprocal movement in chamber 24 adjacent to the open ends of the bores 26. The actuator 40 additionally has a foot portion 42. A pattern of apertures 44 is provided in the actuator member leg portion with the apertures being located so as to receive pins of the pin stacks 30. In the locked condition of FIG. 2*a*, both of the head pins 34 which are shown extend through aligned apertures 44. The foot portion 42 of actuator member 40 is connected in an articulated manner to the operating member 46 of an electrical switch 48, switch 48 having contacts which define the switch state, i.e., either open or closed. The actuator member 40 is preferably guided on its two narrow sides and is moveable along the adjacent end face of the insert 22. The interface between actuator member 40 and the adjacent end face of insert 22 defines a shear line or plane. The actuator member 40 does not occupy the full width of the actuator chamber 24. Accordingly, the blade 50 of a key may be inserted into chamber 24, parallel to the actuator 40, via an aligned slot 25 in a first side of housing 20.

Figure 2C:
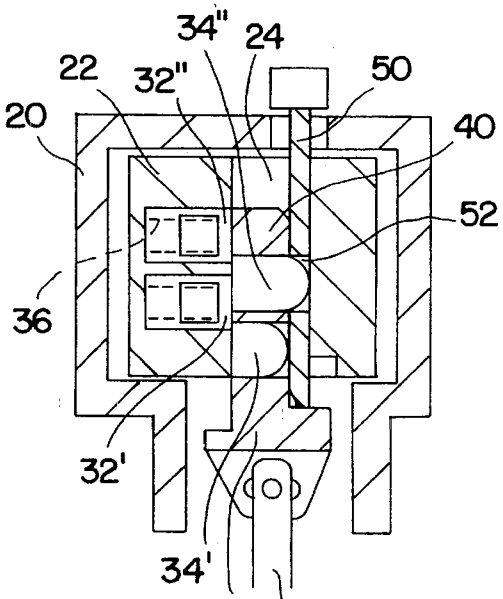
FIGS. 2*a*, 2*b* and 2*c* are cross-sectional views of the switch of FIG. 1, the figures demonstrating operation of the switch.
Figure 2B:
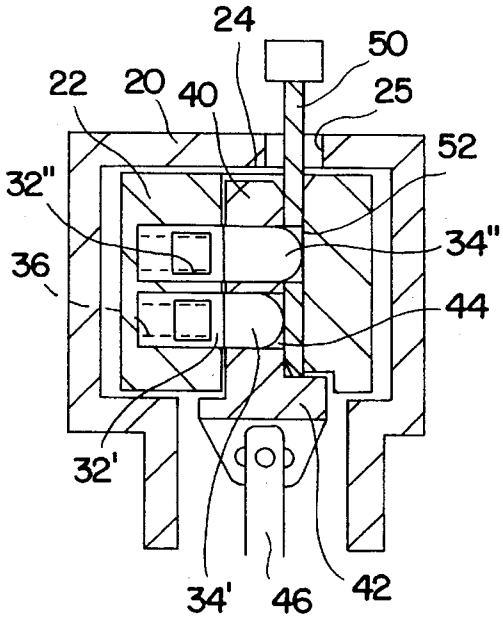
Figure 2A:
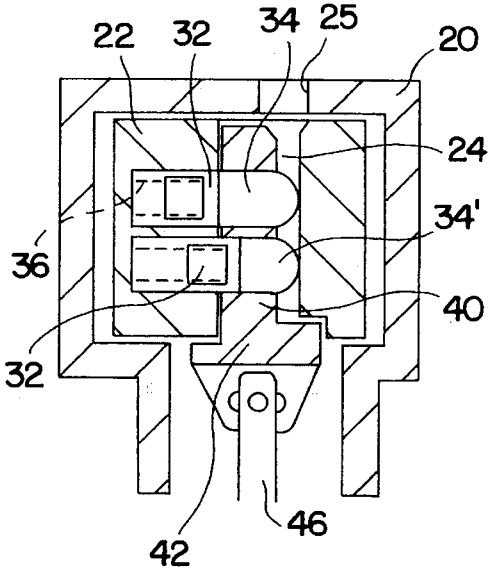

The key blade 50 is provided with a pattern of pin receiving holes 52 corresponding to an intended coding. In the embodiment of FIGS. 1 and 2, head pins 34 of differing length are utilized to code the switch. Some of the head pins 34 have a length corresponding to the width of chamber 24 in insert 22 and the remainder have a smaller length. At least one short head pin 34' and one long head pin 34" are utilized in each switch 10 (see FIGS 2*b* and 2*c*). The foot pin(s) 32' associated with the short head pin(s) 34' traps the actuator member 40 in the locked position (FIG. 2*a*) by extending across the shear line between the actuator member and insert. When the key blade 50 is in the inserted position, pin receiving holes 52 therein are positioned opposite insert bores containing long head pins 34" (FIG. 2*b*) while pin stacks having "short" head pins 32' are forced in a direction opposite to the spring bias by the key 50. This results in the repositioning of the pin stacks to place the interfaces between all of the pins 32 and 34 on the shear line between the actuator member and insert. The key 50 does not have receiving holes 52 at locations corresponding to insert bores 26 containing short head pins 34'.

The key blade 50 has a bevelled leading edge that cams back the pin stacks 30 against the force of the compression springs 36 on insertion. When the key is in the inserted position the long head pins 34" are pushed into the holes 52 in the key by the compression springs 36, thereby coupling the actuator member 40 to the key (FIG. 2*b*), and the short head pins 34' will be spring biased against the surface of an inserted key 50. Accordingly, further insertion of the coupled key 50 and actuator member 40 actuates the switch 48, i.e., mechanically alters the electrical state of the switch (FIG. 2*c*).

If an improperly coded or "false" key is used, the long head pins 34" will not be received by holes 52 in key blade 50 or short head pins 34' may enter holes in the "false" key blade. In either case, the actuator 40 member will be locked against movement relative to the insert 22. The actuator 40 cannot be released by means of a simple tool, plate or the like.

When the key blade 50 is withdrawn the actuator member 40 which is coupled to the key 50 by head pins 34" is also withdrawn until the actuator foot portion 42 butts against the bottom of insert 22. Further withdrawal of the key 50 reverses the process described above locking the actuator member 40 in relation to the insert 22.

Figure 3:
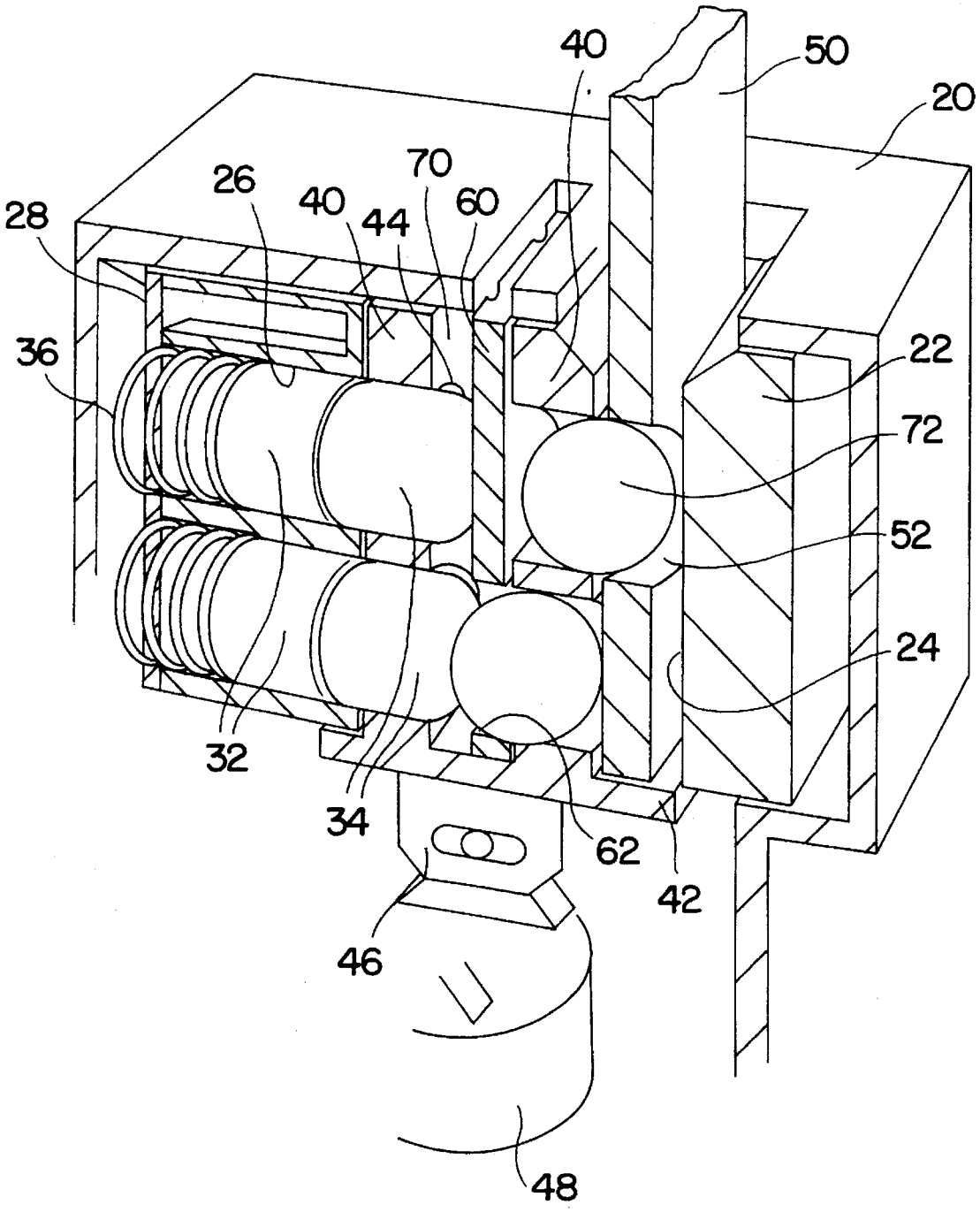
FIG. 3 is a partial perspective view of an alternate embodiment of a key operable safety switch in accordance with the present invention.

FIG. 3 shows an alternate embodiment which employs head pins 34 of equal length and a code card 60 which matches key blade 50 to the actuator member 40.

The insert 22 of the FIG. 3 embodiment is provided with a slot 70 that receives the card 60. The slot 70 is perpendicular to the axes of the bores 26 and is positioned intermediate the wall 28 and the "first" slot, i.e., the portion of actuator chamber 24 which receives an inserted key. A coding member in the form of a ball 72 which functions as a further pin element of each pin stack is disposed in each of the bores 26 adjacent the pins 34. The rounded heads of the head pins 34 extend over the width of the second insert receiving slot 70 (FIG. 4*a*).

The code card 60 has through holes 62 corresponding to the intended coding. When initially inserted in the second insert slot 70, the card 60 initially pushes each head pin 34 back towards the wall 28. When the card 60 is in the inserted position, the pin stacks 30 located in the bores 26 which are in registration with holes 62 in card 60 are pushed through these aligned holes 62 by the associated compression springs 36. The pin stacks 30 located in bores 26 which have no corresponding card holes 62 push the card 60 against the wall of slot 70 nearest the key insertion slot portion of chamber 24 (FIG. 4*b*).

The key blade 50 has the same width as the card 60. During insertion, the key blade 50 cams the balls 72 towards the pin stacks 30. Where a head pin 34 extends through a card hole 62, the pin stack 30 is pushed back towards the wall 28. Where the card 60 is interposed between a ball 72 and a pin stack 30, the ball 72 pushes, i.e., translates, the card 60 to the position where it is against the wall of slot 70 farthest from the key insertion slot (FIG. 4*c*).

When the key is in the partly inserted position of FIG. 4*d*, the balls 72 which are separated from adjacent head pins 34 by the card 60 are received by the apertures 44 in actuator member 40. The compression springs 36, acting against the head pins 34, are thus able to push the card 60 back to the position where it abuts the wall of the slot 70 nearest the first insert slot 24. The remaining balls 72 bear against the key blade 50 whereby the interfaces between the first and head pins of each pin stack are positioned on the shear line between the actuator member 40 and insert 22 (FIG. 4*d*). Further insertion of the coupled key is thus able to impart movement to actuator member 40 and actuate the switch 48 via its operating member 46 (FIG. 4*e*).

Coding pieces of varying length may be used instead of the code card 60 wherein those code pieces that are not received by holes 52 in the key are designed as balls. If necessary, the foot pins may be omitted and the compression springs 36 may directly engage the head pins 34.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A safety switch comprising:

a housing, said housing having a key entry slot extending linearly into said housing from an exterior thereof to define a direction of insertion for a planar key blade, said housing defining an actuator chamber which is in communication with said key entry slot, said housing further having a plurality of pin chambers arranged in a pattern, said pin chambers communicating with said actuator chamber, said pin chambers having parallel axes, said axes being oriented substantially perpendicularly with respect to said direction of key insertion;

a switch device at least in part disposed within said housing, said switch device including an electrical switch and a movable switch operator, said electrical switch having open and closed states, the state of said electrical switch varying in response to movement of said operator;

actuating means for imparting movement to said switch operator, said actuating means comprising a unitary member, said actuating means being movably disposed within said housing actuator chamber and being longitudinally movable in a direction generally parallel to said direction of key insertion, said actuating means being coupled to said switch operator and being displaceable over a predetermined stroke to impart motion to said switch operator, said actuating means being provided with a plurality of holes, at least some of said holes extending through said actuating means, said actuating means holes being arranged in a pattern commensurate with the pattern of pin chambers in said housing;

at least one codeable pin means for selectively permitting and preventing movement of said actuating means, said pin means being movably disposed within said housing pin chambers, each of said pin means having at least first and second pin members, said first and second pin members being coaxial with one another and with the associated pin chamber, the first pin member of at least one of said pin means being engageable with a through hole in said actuating means for locking said actuating means in a fixed position relative to said housing in the absence of the presence of a properly coded key in said housing slot, said at least one pin means extending through said actuating means into registration with said key entry slot;

spring means for biasing said pin means in the direction of said actuation means, said spring means being disposed in said housing pin chambers and engaging a pin member of said pin means; and a key insertable into said housing actuator chamber via said key entry slot, said key having a planar blade with a coded pattern of apertures for receiving at least one of said spring means biased pin means pin members including a pin member of said at least one pin means to thereby release said actuator means to permit movement thereof from said fixed position, said key imparting movement to said actuator means upon the release thereof to cause movement of said actuator means over said predetermined stroke.

2. The switch of claim 1 wherein said actuating means further comprises a foot portion, said foot portion acting as a stop for said key blade during insertion of said key.

3. The switch of claim 1 wherein said housing further comprises an outer housing portion and an insert disposed within said outer housing portion, said insert defining said pin chambers and in part defining said actuator chamber.

4. The switch of claim 1 wherein said first pin member of each of said pin means comprises a head pin, each of said head pins having oppositely disposed first and second ends, said head pin first ends facing away from said housing key entry slot, said head pin first ends being aligned when a properly coded key is inserted into said housing via said key entry slot.

5. The switch of claim 4 wherein each of said pin means comprises a pin stack, said pin stack including said head pin and a driver pin, said spring means engaging said driver pin.

6. The switch of claim 4 wherein said pin means each define a pin stack including at least a driven pin contacted on a first end by a said spring means and a said head pin, said pins of at least some of said pin stacks being of unequal length whereby some of said pin stacks are longer than others of said pin stacks, head pins of said longer pin stacks engaging said through holes in said actuating means.

7. The switch of claim 6 wherein said longer pin stacks define long pin stacks and said other pin stacks define short pin stacks, wherein said first pin members of said short pin stacks are engageable with said holes in said actuating means for locking said actuating means in a fixed position relative to said housing in the absence of the presence of a properly coded key in said housing slot.

8. The switch of claim 4 wherein said head pins of said pin means are of equal length and wherein said pin stacks further comprise coding members axially aligned with said pin chambers when a properly coded key is not inserted in said key entry slot, said coding members being movable axially with respect to said pin chambers and also being movable in the direction of key insertion, at least some of said coding members engaging an aperture in said key blade.

9. The switch of claim 8 wherein said actuating means further comprises a code card, said code card being provided with at least a first hole which is in registration with a first of said pin chambers, said first hole being positioned and sized to engage one of said coding members, said code card being moveable in the direction of key insertion with said actuating means and also being moveable in the direction of said pin chamber axes.

10. The switch of claim 8 wherein said coding members are in the form of spheres.

11. An electrical safety switch comprising:

a housing, said housing defining first and second entry slots in a first side thereof, said slots being oriented generally transversely with respect to said housing first side, said housing further defining an internal actuator chamber in communication with said slots;

an electrical switch, said switch having open and closed states and being operable in response to movement of an operator;

a switch operator at least in part disposed within said housing, said switch operator being connected to said switch and being moveable to cause a change in the electrical state of said switch;

actuating means for actuating said switch operator, said actuating means comprising a unitary member, said actuating means being disposed within said housing actuator chamber and being at least in part in registration with said first and second slots, said actuating means being articulated to said operator and being displaceable over a predetermined stroke in a direction generally transverse to said housing first side to impart movement to said operator;

a plurality of codeable pin means for selectively permitting and preventing movement of said actuating means, said pin means being disposed within said housing for reciprocal movement, said pin means each having an axis and comprising a pin stack including a plurality of axially aligned pins, said pin means having opposed first and second ends, said pin means axes being substantially parallel and also being oriented substantially perpendicular to said first and second slots, each of said pin means including at least a head pin and further comprising an axially aligned and separately moveable coding member positioned at a first end of the pin stack, said head pins being extendable into said second slot and said coding members being extendable into said first slot, at least one of said pin means pin members being simultaneously engageable with said actuating means and said housing for locking said actuating means in a fixed position relative to said housing in the absence of a properly coded key;

spring means for biasing said pin means towards said first and second slots, said spring means being disposed in said housing and engaging said pin means at the second ends thereof disposed oppositely with respect to said coding members;

a code card insertable into said second slot, said code card having a coded pattern of apertures, said code card being positioned between at least one of said head pins and an associated coding member, at least another of said head pins engaging an aperture in said code card, said code card being movable with said actuating means in a first direction and being movable relative to said actuating means in a second transverse direction in response to key induced movement of said coding members; and a key insertable into said first slot, said key having a coded pattern of holes corresponding to at least some of said pin means whereby said at least some of said pin means may move axially to release said actuating means from said fixed position, said coding members being positioned to couple a properly coded key to said actuating means whereby said key will move said actuating means over said stroke after the release thereof.

12. The switch of claim 11 wherein said first and second slots each have a width, said code card and said key each having a thickness substantially equal to said width of said second slot less said width of said first slot.

* * * * *